United States Patent [19]

Henke et al.

[11] Patent Number: 4,834,237

[45] Date of Patent: May 30, 1989

[54] WALLCOVERING KIT APPARATUS AND METHOD

[75] Inventors: David R. Henke, Maple Grove; Douglas B. Malchow, St. Louis Park, both of Minn.

[73] Assignee: Warner Manufacturing Company, Minneapolis, Minn.

[21] Appl. No.: 232,299

[22] Filed: Aug. 15, 1988

[51] Int. Cl.[4] ..... B65D 1/36

[52] U.S. Cl. ..... 206/373; 206/223; 206/592; 206/503; 206/459; 15/257.06

[58] Field of Search ..... 206/373, 223, 229, 592, 206/503, 44.11; 15/257.06

[56] References Cited

U.S. PATENT DOCUMENTS

| | | | |
|---|---|---|---|
| 1,987,822 | 1/1935 | Gregory | 206/223 X |
| 3,591,299 | 7/1971 | Pharris | 15/257.06 X |
| 4,293,074 | 10/1981 | Dunsky | 206/373 X |
| 4,509,226 | 4/1985 | Allison et al. | 15/257.06 |
| 4,547,926 | 10/1985 | Kern | 15/257.06 |
| 4,642,835 | 2/1987 | Schmitz | 206/229 X |

*Primary Examiner*—William Price

*Attorney, Agent, or Firm*—Merchant, Gould, Smith, Edell, Welter & Schmidt

[57] ABSTRACT

A wallcovering tool kit (10) and a method for hanging wallcovering are disclosed. The kit (10) includes a tray (11) and a cover (20) which is sized and configured to completely cover the tray (11). The cover (20) includes a plurality of tool storing compartments (21) having divider walls (22) which are sized and configured to hold the tools (42). Holding means within the compartments (21) comprise a plurality of protrusions (34) or guide posts (35) which correspond to the design of the individual tools. The outer perimeters of both the tray (11) and cover (20) are cooperatively attachable in order to hold the tray and cover together.

24 Claims, 3 Drawing Sheets

WALLCOVERING KIT APPARATUS AND METHOD

BACKGROUND OF THE INVENTION

1. Field of the Invention

This invention relates to devices for interior decorators, and more particularly, to a wallcovering kit and an apparatus for holding wallcovering tools.

2. Description of the Prior Art

It is common for wallcovering tools to be sold in conjunction with a tray which is capable of holding paint or paste adhesive for the wallcoverings. However, the packaging of such tools is typically a loose cardboard cover and plastic film which is shrink-wrap sealed. Alternatively, a heat-sealed plastic bag may be used. While this type of disposable packaging may be suitable for displaying the tools in the store, the consumer has no convenient place to store the tools once the package has been opened. Other types of conventional packaging do not provide for the clear display of the tools, so that the consumer knows the type and size of tools being purchased.

A tray for wallpaper adhesive and tools has been patented by Lugo in U.S. Pat. No. 4,669,609, but this type of tray does not have pre-formed storage compartments which correspond to the shape of the various tools. In addition, this type of tray does not lend itself to easily packaging and displaying various wallpapering tools within the tray itself. While the patent does disclose a relatively small cover for one end of the tray, there is no provision for a protective cover over the entire tray which is able to keep the adhesive paste moist.

The present invention addresses these and many other problems associated with currently available wallcovering kits.

SUMMARY OF THE INVENTION

The present invention also relates to an apparatus for holding wallcovering tools. The apparatus includes a tray having a bottom wall, side walls, and end walls, as well as cover means which is sized and configured to completely cover the tray. The cover means includes a plurality of tool storing compartments having divider walls which are sized and configured to hold the tools. According to the preferred embodiment of the invention, the tool storing compartments include holding means for securing the tools within the corresponding compartments, with the holding means being a plurality of protrusions and guide posts which correspond to the design of the individual tools. In the preferred embodiment, the outer perimeters of both the tray and cover means are cooperatively attachable in order to hold the tray and cover together.

According to another aspect of the invention, a method for hanging wallcoverings is described. The method comprises the steps of: removing the cover from the wallcovering kit, with the tools being positioned within storage compartments within the cover; suitably preparing the wall to be covered with the tools; filling the tray with adhesive paste; hanging the wallcoverings by utilizing the paste and the tools; cleaning the tray; positioning the tools within the respective storage compartments; and placing the cover on the wallcovering kit. Further, the cover's storing compartments can be used during the wallcovering hanging process for holding and organizing the tools, and the kit's cover may also be placed upon the tray in order to keep the adhesive paste moist.

The present invention is advantageous in that its cover is designed to have storing compartments so that various wallcovering tools can be positioned in place in the cover. This allows the tools to be conveniently stored by the user, as well as allowing easy selection of the desired tool when needed. The cover also features holding means which cooperate with the various tools to hold them securely in place. In addition, the transparent plastic cover of the present invention allows the tools to be displayed for the consumer in an attractive and organized manner. The kits are also designed to allow for flat storage of multiple kits in the store.

Another feature of the wallcovering kit of the present invention is that the bottom tray can be utilized for holding paste, paint, or pre-wallcovering sealer. The tray is sized and configured to hold a sufficient amount of paste or sealer. Further, the cover of the present invention can be used to seal the tray during breaks in the wallcovering hanging process, in order to prevent the paste or sealer from drying out.

Another feature of the present invention is that the cover is molded to include a flat area suitable for application of a pressure sensitive label or shrinkwrapped plastic band, for a tamper-proof seal. In addition, the cover is designed to have a label insert display area for information display.

Yet another feature of the present invention is the removable interconnection between the tray and cover of the wallcovering kit. The cover is designed to fit tightly onto the tray, in order to hold the wallcovering tools therewithin. Further, the cover and tray have hang tabs to enable the wallcovering kit to be stored or displayed in a vertical position, as with a pegboard display.

These and other features of the invention will become apparent from a consideration of the following description of the invention and accompanying drawings which form a part of this application.

DETAILED DESCRIPTION OF THE PREFERRED EMBODIMENT

Figure 1:
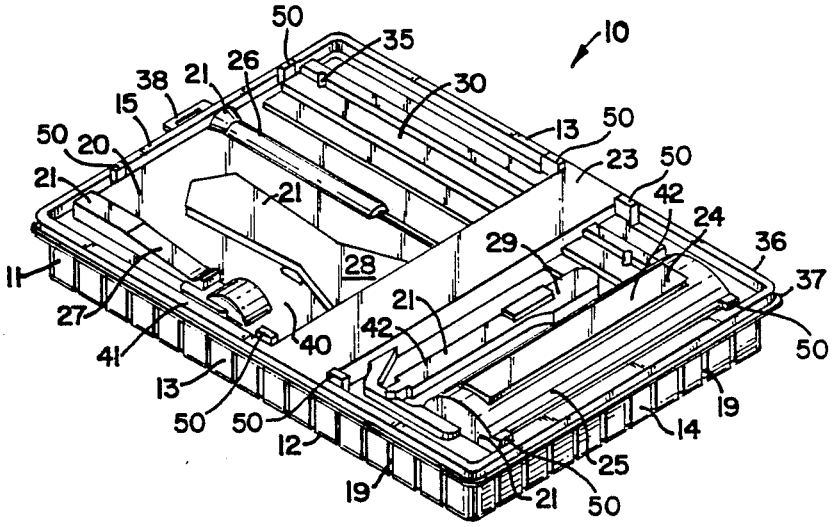
FIG. 1 is a perspective view of the wallcovering kit of the present invention.
Figure 2:
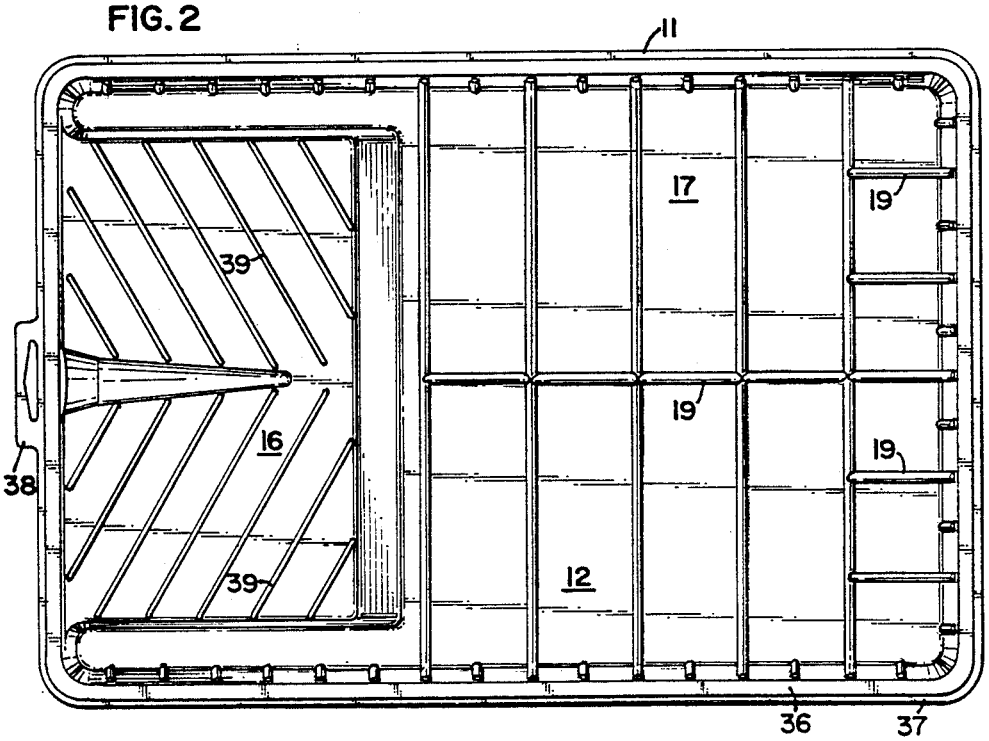
FIG. 2 is an inside bottom view of the tray utilized with the wallcovering kit of the present invention.

The wallcovering kit of the present invention is shown generally at 10. The wallcovering kit 10 includes a bottom tray 11 having a bottom wall 12, a pair of side walls 13 and end walls 14, 15. On the end of the tray 11 closest to the end wall 15, the bottom wall 12 of the tray 11 has a substantially rectangular raised portion 16. On the other end of the tray 11 is a lower portion of sump 17 which is formed in the tray body 11 for receiving wallpaper adhesive (not shown). A plurality of ridges 39 are provided on the raised bottom portion 16 for removing excess adhesive from a roller or brush.

The sump 17 of the tray 11 occupies a majority of the tray bottom 12. The bottom surface of the sump 17 is flat to allow for flat storage of the wallcovering kit 10. In the preferred embodiment, a plurality of grooves 19 are formed in the bottom and sides of the tray 11.

The wallcovering kit 10 also includes a cover 20. The cover 20 is sized and configured to correspond to and completely cover the tray 14. The cover 20 has an upper, substantially flat portion 40 and border portions 41 on each side of the cover 20. In the preferred embodiment, both the tray 14 and cover 20 are substantially rectangular in shape, although variations in size and shape may be made within the scope of the present invention.

In the preferred embodiment, the cover 20 is made of a suitable transparent plastic material, and the cover is manufactured by a vacuum-formed process. In this manner, a single, unitary cover or lid 20 is formed. In the preferred embodiment, the tray 11 is also formed of a suitable sturdy plastic material which will provide sufficient strength and rigidity.

The cover 20 includes a plurality of tool storing compartments 21. Raised divider walls 22 define the boundaries of the compartments 21, with the divider walls 22 corresponding to the size and shape of the tools 42 within the wallcovering kit 10.

In the preferred embodiment, a variety of tools 42 are contained within the wallcovering kit 10. The selection and design of the tools can be varied within the scope of the present invention. Specifically, a roller 25 having a suitable nap to handle the appropriate wallcovering sealers and paste contained within the wallcovering kit 10. Interconnected to the roller 25 is a roller handle 26. Other tools contained in the illustrated embodiment of the wallcovering kit 10 include: a seam roller 27 having a handle; a patcher and trim guide 28, preferably having a blade with squared corners and interconnected handle; a wallcovering knife 29; and a smoother tool 30 having bristles 31 on one side and a flexible straight edge 32 on the other side. Also included is a rectangular paste sponge 33 which is shown by broken lines in FIG. 3 so that the construction of the other tools can be viewed. The sponge 33 is preferably positioned on top of the sump portion 17 of the tray bottom for optimal space efficiency.

Various storing compartments in the cover 20 correspond with the size and configuration of each of the tools, except for the sponge which does not fit within the cover 20. The side walls 22 fit closely against the edge of the tools 42, but flex outward slightly when the tool 42 is being removed from the cover or replaced therein.

Figure 3:
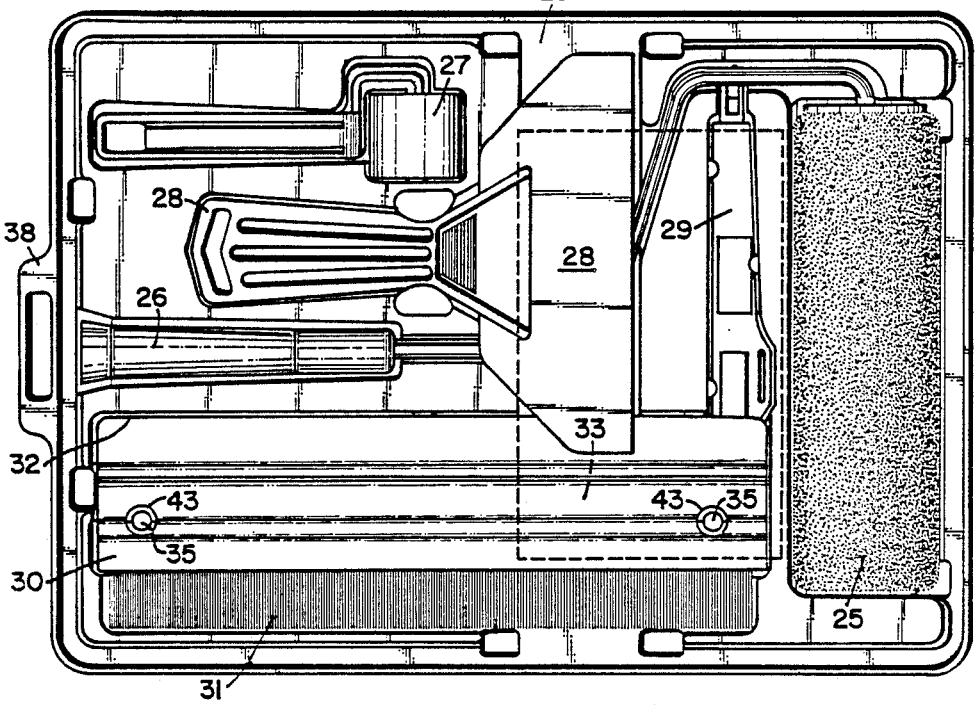
FIG. 3 is a plan view of the cover of the present invention with the tools in their respective storing compartments.
Figure 4:
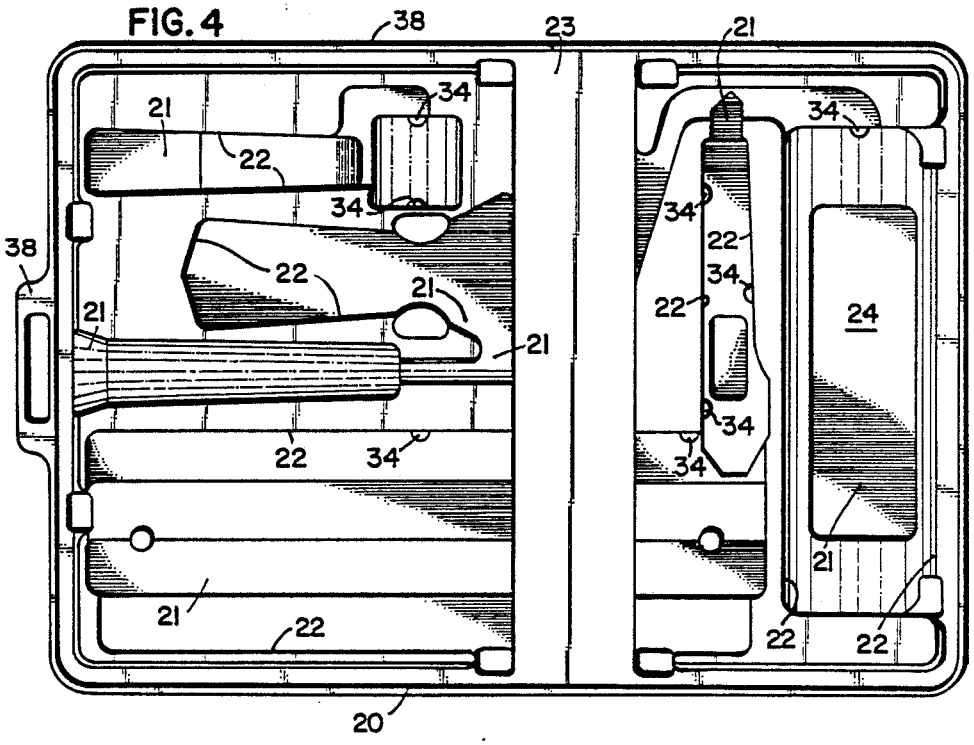
FIG. 4 is a plan view of the cover of the present invention without the tools being in their respective storing compartments.

The present invention also includes holding means for securing the tools 42 within the corresponding tool storing compartments 21. In the preferred embodiment, the holding means consists of a plurality of protrusions 34 which extend outwardly from the divider side walls 22 of the tool storing compartments 21. Preferably, the protrusions 34 are rounded and knobular in shape, but other sizes and shapes for the protrusions would suffice to hold the tools 42. The protrusions or knobs 34 may be positioned on one or more of the side walls 22 of a particular storing compartment 21. For example, as shown in FIG. 3, there is a knob 34 on each end of the roller 25. The holding means 34 is optional, and not all of the storing compartments 21 have protrusions 34. When a tool 42 is placed within its compartment, the tool forces the walls 22 slightly outward, and when the tool 42 is in place, the walls 22 snap back so that the knobular portion 34 secures the tool.

Another form of holding means is guide posts 35 which extend outwardly from the cover 20. The cylindrical guide posts 35, shows in FIG. 3, correspond with apertures 43 in the smoother tool 30 and are inserted therethrough when the smoother tool 30 is placed within its storing compartment 21 in the cover 20. As illustrated, the guide posts 35 are utilized in conjunction with the smoother tool 30, but could also be used in conjunction with other tools.

The cover 20 also has a flat portion 23 suitable for application of a label (not shown) or shrink-wrapped plastic band (not shown), and behind which a brochure or other information can be inserted. Another raised area 24 above the roller 25 is suitable for insertion of a label or other insert.

In the preferred embodiment, the upper end of the tray 11 has a border 36 about its periphery. As illustrated in FIG. 1, the border 36 has a substantially flat horizontal top, curving into a vertical position with the bottom of the border being a substantially horizontal, outwardly projecting flange portion 37. To cooperate with the border 36, there is a U-shaped groove 38 in the upper periphery of the cover 20. The groove 38 snaps into place onto the border 36, with the lower edge of the groove 38 touching the flange 37, for a secure attachment of the cover 20 to the bottom tray 12.

In the preferred embodiment, both the cover 20 and tray 12 also have a hang tab portion 38, 39, respectively. The tabs 38, 39 have an aperture for vertical hanging of the wallcovering kit, for example, in a pegboard arrangement.

Figure 5:
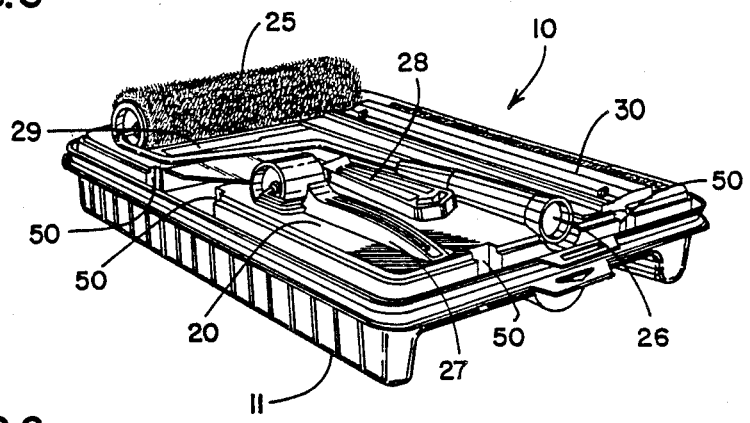
FIG. 5 is a perspective view of the wallcovering kit when the cover has been flipped over so as to expose the tools and yet cover the tray.

As illustrated in FIG. 5, the cover 20 can be flipped over and mounted upside down on the tray 11 to expose the tools 42 and yet cover the tray 11 during breaks. When flipped over, the border portions 41 of the cover 20 rest on the tops of the tray walls 13, 14, 15. Projections 50 are present, to cooperate with the inside surfaces of the tray walls 13, 14, 15 so as to prevent the cover 20 from sliding off the tray 11.

Figure 6:
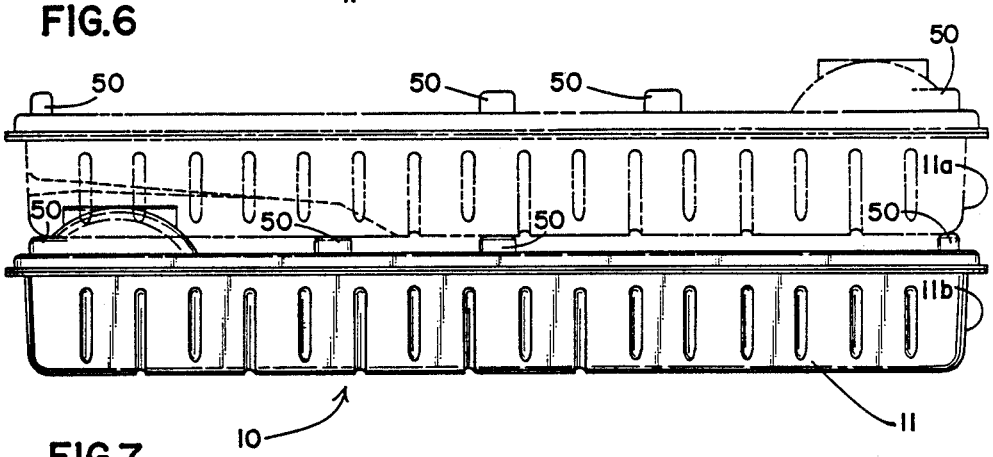
FIG. 6 diagrammatically illustrates stacking of the trays.
Figure 7:
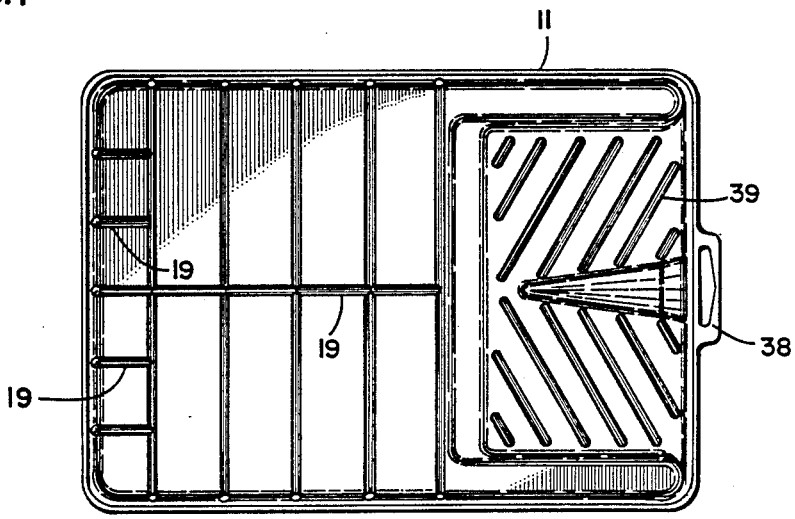
FIG. 7 is an outside bottom view of the tray.

As illustrated in FIG. 6, the unique design of the tray 11 and cover 20 allow the wallcovering kit to be stacked substantially flat on top of one another, while occupying a space roughly the height of the tray walls 13, 14, 15. When so stacked, the trays are alternately switched end for end as generally illustrated by trays **11*a* and 11*b* in FIG. 6. As illustrated, the compact stacking is partially enabled by a recessed portion 52 opposite the raised portion 16 which is configured to receive a portion of the roller compartment 42 which projects above the surface 20 of the cover. As illustrated, the tray 11*a* rests on the projection 50 of tray 11*b***.

In operation, the user accomplishes the wallcovering task by removing the cover 20 from the wallcovering kit 10, and turning the cover 20 over to allow access to the tray 11 and to the various tools 42 contained within the wallcovering kit 10. The user then prepares the wall to be covered with the appropriate tools, and fills the tray 12 with adhesive paste. The process of hanging the wallcoverings then proceeds, with the user being able to store the tool 42 within the cover's storage compartments 21 for easy access. In addition, the cover 20 can be placed upon the tray 11 during breaks in the wallcovering process in order to keep the adhesive paste or sealer moist. After the wallcovering task is completed, the tray 12 can be cleaned, and the various tools can be returned to their storage compartments 21 within the cover 20, and the cover 20 returned to the top of the wallcovering kit 10 for either flat storage or vertical storage upon a pegboard.

It is to be understood that numerous and various modifications can be readily desired in accordance with the principles of the present invention by those skilled in the art without departing from the spirit and scope of the invention. Therefore, it is not desired to restrict the invention to the particular construction illustrated and described but to cover all modifications that may fall within the scope of appended claims.

What is claimed is:

1. An apparatus holding wallcovering tools, comprising:

(a) a tray including a bottom wall and including side walls and end walls extending upwardly from the perimeter of said bottom wall; and (b) cover means sized and configured to correspond to and completely cover said tray, said cover means including a plurality of tool storing compartments having divider walls sized and configured to correspond to and hold said tools.

2. The apparatus holding wallcovering tools according to claim 1, further comprising holding means for holding said tools within their corresponding tool storing compartments.

3. The apparatus holding wallcovering tools according to claim 2, wherein said cover means is made of a plastic material.

4. The apparatus holding wallcovering tools according to claim 3, wherein said holding means comprises a plurality of protrusions extending outwardly from said divider walls of said tool storing compartments.

5. The apparatus holding wallcovering tools according to claim 3, wherein said holding means comprises a guide post extending outwardly from said cover means, said guide post cooperating with an aperture in a wallcovering tool.

6. The apparatus holding wallcovering tools according to claim 2, wherein a top end of said side walls includes a border, and the perimeter of said cover means includes a continuous groove which cooperates with said border to hold said tray and cover means together.

7. The apparatus holding wallcovering tools according to claim 3, further comprising hanging means for hanging said kit in a substantially vertical position.

8. The apparatus holding wallcovering tools according to claim 1, wherein said tray includes a sump portion.

9. The apparatus holding wallcovering tools according to claim 8, wherein said bottom wall of said tray includes a plurality of ridges.

10. An apparatus holding wallcovering tools, comprising:

(a) a tray including a bottom wall and including side walls and end walls extending upwardly from the perimeter of said bottom wall; and (b) cover means sized and configured to correspond to and completely cover said tray, said cover means being substantially transparent and made of a plastic material, said cover means including a plurality of tool storing compartments having divider walls which surround the perimeter of each tool.

11. The apparatus holding wallcovering tools according to claim 10, further comprising holding means for holding said tools within their corresponding tool storing compartments.

12. The apparatus holding wallcovering tools according to claim 11, wherein said holding means comprises a plurality of protrusions extending outwardly from said divider walls of said tool storing compartments.

13. The apparatus holding wallcovering tools according to claim 11, wherein said holding means comprises a guide post extending outwardly from said cover means, said guide post cooperating with an aperture in a wallcovering tool.

14. The apparatus holding wallcovering tools according to claim 13, wherein a top end of said side walls includes a border, and the perimeter of said cover means includes a continuous groove which cooperates with said border to hold said tray and cover means together.

15. The apparatus holding wallcovering tools according to claim 14, further comprising hanging means for hanging said kit in a substantially vertical position.

16. The apparatus holding wallcovering tools according to claim 15, wherein said tray includes a sump portion.

17. The apparatus holding wallcovering tools according to claim 16, wherein said bottom wall of said tray includes a plurality of ridges.

18. A method for hanging wallcoverings, comprising the steps of:

(a) removing a cover of a wallcovering kit, said kit including a bottom tray and a plurality of wallcovering tools therewithin, said tools being positioned within storage compartments in said cover;

(b) preparing a wall with said tools;

(c) filling said tray with adhesive paste;

(d) hanging said wallcoverings with said paste and said tools;

(e) cleaning said tray; and (f) positioning said tools within said storage compartment and placing said cover on said wallcovering kit.

19. The method for hanging wallcoverings according to claim 18, further comprising the step of periodically placing said cover on said tray during said hanging step to keep said paste moist.

20. The method for hanging wallcoverings according to claim 18, further comprising the step of storing said tools within said storing compartments of said cover during said hanging step when said tools are not in use.

21. A wallcovering tool kit, comprising:

(a) a plurality of wallcovering tools;

(b) a one piece plastic tray including a bottom wall and including side walls and end walls extending upwardly from the perimeter of said bottom wall; and (c) one piece transparent plastic cover means sized and configured to correspond to and completely cover said tray, a perimeter portion of said tray and said cover means including collaborating tongue and groove means for retaining said cover means on said tray, said cover means including a plurality of tool storing compartments having divider walls sized and configured to correspond to and hold said wallcovering tools.

22. The wallcovering kit in accordance with claim 21, wherein the plurality of wallcovering tools include: (i) a paste roller, (ii) a seam roll, (iii) a trim guide, (iiii) a wallcovering knife, (iiiii) a paste sponge, and (iiiiii) a smoother tool with a flexible straight edge located opposite a bristled edge.

23. The kit in accordance with claim 21, wherein said cover means is mountable upside down on said tray so as to expose the wallcovering tools and yet cover said tray.

24. The wallcovering tool kit in accordance with claim 21, wherein the wallcovering tool kit are vertically stackable in a horizontal orientation with alternating trays being switched end for end.

* * * * *